United States Patent [19]

Kajiwara et al.

[11] Patent Number: 4,942,121

[45] Date of Patent: Jul. 17, 1990

[54] SILVER HALIDE PHOTOGRAPHIC LIGHT-SENSITIVE MATERIAL

[75] Inventors: Makoto Kajiwara; Kaoru Onodera; Toshio Kimura; Kazuo Komorita, all of Odawara, Japan

[73] Assignee: Konishiroku Photo Industry Co., Ltd., Tokyo, Japan

[21] Appl. No.: 811,047

[22] Filed: Dec. 19, 1985

[30] Foreign Application Priority Data

Dec. 24, 1984 [JP] Japan ..... 59-272336

[51] Int. Cl.[5] ..... G03C 1/16; G03C 1/12

[52] U.S. Cl. ..... 430/583; 430/591; 430/642

[58] Field of Search ..... 430/583, 591, 642

[56] References Cited

U.S. PATENT DOCUMENTS

| | | | |
|---|---|---|---|
| 4,147,542 | 4/1979 | Habu et al. | 430/583 |
| 4,250,244 | 2/1981 | Barror et al. | 430/583 |
| 4,360,590 | 11/1982 | Tomka | 430/642 |

*Primary Examiner*—Richard L. Schilling

*Attorney, Agent, or Firm*—Jordan B. Bierman

[57] ABSTRACT

A silver halide photographic light-sensitive material comprising a support having at least one hydrophilic colloidal layer having spectrally sensitized silver halide grains. There are particular sensitizers which are used and the colloidal layer contains gelatin which has a saturated solubility of not more than ten in an amount of at least 35% by weight.

7 Claims, 1 Drawing Sheet

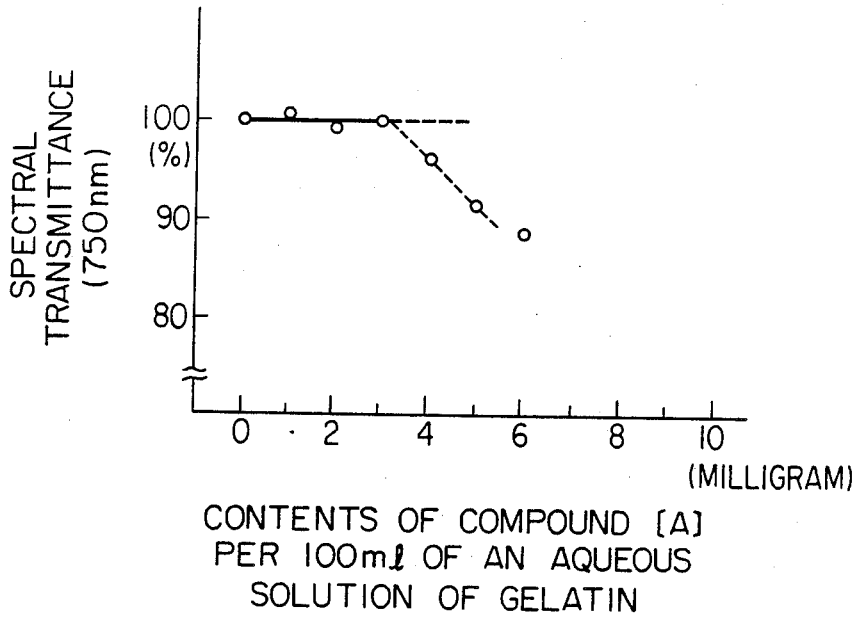
SPECTRAL TRANSMITTANCE (750nm)
100 (%)
90
80
0
2
4
6
8
10
(MILLIGRAM)
CONTENTS OF COMPOUND [A] PER 100mℓ OF AN AQUEOUS SOLUTION OF GELATIN

SILVER HALIDE PHOTOGRAPHIC LIGHT-SENSITIVE MATERIAL

BACKGROUND OF THE INVENTION

This invention relates to a silver halide photographic light-sensitive material and more particularly to a silver halide photographic light-sensitive material which is high in sensitivity, excellent in photographic characteristics and, inter alia, less in sensitivity variation and stable in quality.

In recent years, there have been demands for highly sensitive silver halide photographic light-sensitive materials (hereinafter called a light-sensitive material) year by year from the various viewpoints, and many sensitizing techniques have been studied in all its aspects.

Among the studies on the sensitizing techniques relating to silver halide grains, there is, for example, the study in which the quantum efficiency of silver halide grains is theoretically computed to discuss the influence of grain-size distributions, which was published in the pre-print circulated in the Tokyo Symposium 1980 on the progress in photography, 'Interactions between light and materials for photographic applications' p. 91. According to this study, it is suggested that the preparation of monodispersive emulsions may be effectual to improve a silver halide quantum efficiency, that is to say, it may be able to make a silver halide emulsion highly sensitive. On the other hand, as the other studies of sensitizing techniques, there are investigations of the most suitable chemical sensitization applicable to the silver halide emulsions. There are well-known sensitizers useful in chemical sensitization, such as a sulfur sensitizer, a selenium sensitizer, a reduction sensitizer, a nobel metal sensitizer and the like. The above-mentioned chemical sensitizers are used independently or in combination. In addition, there have been studied on various methods of further increasing the sensitization effects by making use of the above-mentioned chemical sensitizers. The studies thereon include, for example, a proposal of the method of chemically sensitizing silver halide grains in the presence of a silver halide solvent as disclosed in Japanese Patent Publication Open to Public Inspection (hereinafter called Japanese Patent O.P.I. Publication) No. 30747/1983; a proposal of the metal of chemically sensitizing silver halide grains in the presence of a nitrogen-containing heterocyclic compound capable of forming a complex with silver as disclosed in Japanese Patent O.P.I. Publication No. 126526/1983; and the like.

It is also a publicly known technique that a spectral sensitizer is added to a silver halide emulsion to widen the inherent light-sensitive wavelength range of the silver halide emulsion and, thereby the emulsion is spectrally sensitized.

It is greatly contributable to the high sensitization of a light-sensitive material when choosing a spectral sensitizer having a high spectral sensitization efficiency to be used therein, that is also well-known.

As for the spectral sensitizers to be placed at the service for the above-mentioned purpose, they are chosen from those having such desirable characteristics as that the spectral sensitization wavelength range thereof is well fitted, and there occurs neither of any diffusion thereof to other light-sensitive layers and any interaction thereof with additives other than the spectral sensitizers.

The further desired requirements are the satisfactory reduction of sensitivity lowering, fog occurrence, dye stain occured after a sensitizing treatment or the like, when preserving a light-sensitive material containing spectral sensitizers. In particular, in the case if using spectral sensitizers in a multi-layered color photographic light-sensitive material, it is required to be high in sensitivity, excellent in color reproducibility, and stable in photographic characteristics, even if the material is preserved for a long period of time, as the essential requirements.

On the other hand, among the characteristics required for light-sensitive materials, the stability of quality is one of the important. It is essential that the various characteristics of light-sensitive materials are to constantly be stable. If they should be varied, the quality of a finally obtained image will inevitably be varied. If the variation is tried to compensated every time when it occurs, the light-sensitive material will seriously be complicated to handle. Among the variations of the characteristics, the variations of sensitivity will affect the light-sensitive material seriously, therefore, the scattering of sensitivity is required to inhibit at a minimum so that no practical trouble is caused. There may be some instances where such scattering of sensitivity of light-sensitive materials may be caused according to the preserved conditions during the period until the manufactured light-sensitive materials are used. It may, however, be prevented a light-sensitive material from scattering of the sensitivity thereof caused with the passage of time if the preserving conditions could be controlled. In contrast with the above, if a scattering occurs in manufacture, the problems thereof will be fatal. One of the causes thereof is a problem of the stability of the coating solution of a silver halide photographic emulsion (hereinafter called simply a coating solution). If there is a difference in the sensitivity of a silver halide between the cases of coating the same coating solution on a support immediately after the solution is prepared and after standing of the solution, i.e., if the coating solution stability is poor, it is hard to mass-produce the light-sensitive materials constant in quality.

Such coating solution stability will depend upon the kinds of spectral sensitizers to be used for spectrally sensitizing a silver halide emulsion. Therefore, even if a spectral sensitizer is high in spectral sensitization efficiency, useful for a high sensitization and capable of displaying various characteristics required for the above-mentioned spectral sensitizers, such a spectral sensitizer is very hard to put in practical use if the coating solution stability thereof is poor.

The methods of improving the coating solution stability include, for example, a method of adding an azole, an azaindene compound or the like which have been known as stabilizers, such as a method of adding such a reducing agent as a hydroquinone or a sulfin; or a method of using some specific copolymer and an optical brightening agent in combination as described in Japanese Patent O.P.I. Publication No. 111629/1974. It may not be said that these methods are able to satisfactorily improve a coating solution stability and, in addition, some of the methods have such a disadvantage as that important photographic characteristics such as gradation and sensitivity are deteriorated.

Besides the above-mentioned methods, there is a method of adding a spectral sensitizer into a coating solution. However, this method had a disadvantage that residual color-stains caused by the spectral sensitizers are of frequent occurrence.

SUMMARY OF THE INVENTION

It is an object of the invention to provide a light-sensitive material less in sensitivity variation caused by the coating solution stability thereof and excellent in stability of quality.

Another object of the invention is to provide a light-sensitive material having a high blue-sensitivity.

The inventors have devoted themselves to the studies with the purpose of achieving the above-mentioned objects and, resultantly, found that the objects can be achieved with a silver halide photographic light-sensitive material comprising a support bearing thereon at least one hydrophilic colloidal layer containing silver halide grains spectrally sensitized with a spectral sensitizer, wherein the spectral sensitizers are selected from those represented by the following Formula [I] and/or [II] and a hydrophilic colloid forming the hydrophilic colloidal layer contains gelatin whose saturated solubility is not more than 10 in an amount of not less than 35% by weight of the colloid. (The gelatin is hereinafter called a gelatin of the invention):

Formula [I]

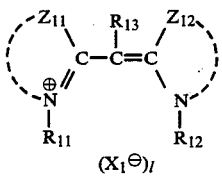

wherein $Z_{11}$ and $Z_{12}$ each represent a group of atoms necessary for forming a benzoxazole nucleus, naphthoxazole nucleus, benzothiazole nucleus, naphthothiazole nucleus, benzoselenazole nucleus, naphthoselenazole nucleus, benzoimidazole nucleus, naphthoimidazole nucleus, pyridine nucleus or quinoline nucleus; $R_{11}$ and $R_{12}$ each represent an alkyl group, an alkenyl group or an aryl group; $R_{13}$ represents hydrogen, a methyl group or an ethyl group; $X_1^{\ominus}$ represents an anion; and l represents zero or 1.

Formula [II]

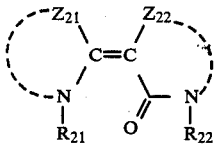

wherein $Z_{21}$ represents a group of atoms necessary for forming a benzoxazole nucleus, naphthoxazole nucleus, benzothiazole nucleus, naphthothiazole nucleus, benzoselenazole nucleus, benzoimidazole nucleus or naphthoimidazole nucleus; $Z_{22}$ represents a group of atoms necessary for forming a rhodanine nucleus, 2-thiohydantoine nucleus or 2-thioselenazoline-2,4-dione nucleus; and $R_{21}$ and $R_{22}$ each represent an alkyl group, alkenyl group or aryl group.

BRIEF DESCRIPTION OF THE DRAWINGS

The drawing attached hereto is a characteristics chart illustrating the relation between the contents of Compound [A] per 100 ml of an aqueous solution of gelatin and the spectral transmittance in terms of 750 nm.

DETAILED DESCRIPTION OF THE INVENTION

The invention will now be described in detail.

In Formula [I], $R_{11}$ and $R_{12}$ each represent independently an alkyl group, alkenyl group or aryl group, and inter alia an alkyl group is preferred, and an alkyl group substituted by carboxyl group or sulfo group is more preferred, and a sulfoalkyl group having 1 to 4 carbon atoms is most preferred; and $R_{13}$ is selected from a group consisting of hydrogen, a methyl group and an ethyl group.

Further, $Z_{11}$ and $Z_{12}$ each represent a group of atoms capable of forming the aforementioned various heterocyclic ring nuclei, and the group of atoms may also be substituted by a substituent. The preferable substituents include, for example, a halogen, a hydroxyl group, cyano group, aryl group, alkyl group, alkoxy group and alkoxycarbonyl group. More preferable substituents include, for example, a halogen, a cyano group, aryl group and alkyl group or alkoxy group having 1 to 6 carbon atoms. The particularly preferable substituents include, for example, a halogen, a cyano group, methyl group, ethyl group, methoxy group and ethoxy group.

In Formula [II], $Z_{21}$ represents a group of atoms necessary for forming the described heterocyclic ring nuclei, and the group of atoms may also be substituted by various substituents. The preferred substituents include, for example, a halogen, a hydroxy group, cyano group, aryl group, alkyl group, alkoxy group and alkoxycarbonyl group. The further preferable substituents include, for example, a halogen, a cyano group, aryl group, alkyl group having 1 to 6 carbon atoms such as methyl group and ethyl group, and alkoxy group such as methoxy group and ethoxy group. When $Z_{22}$ is a 2-thiohydantoine nucleus, the 1-positioned nitrogen is allowed to substitute, and preferable substituents include, for example, an alkyl group, hydroxyalkyl group and alkoxycarbonyl group.

$R_{21}$ and $R_{22}$ are selected from a group consisting of an alkyl group, alkenyl group and aryl group which may be substituted by a substituents, respectively. The preferable substituents thereof include, for example, an alkyl group and aryl group; and the further preferable substituents include, for example, an alkyl group having 1 to 4 carbon atoms, sulfoalkyl group, carboxyalkyl group, aralkyl group such as benzyl group, alkoxyalkyl group such as 2-methoxy ethyl group or 3-methoxypropyl group, alkoxycarbonylalkyl group such as methoxycarbonylpropyl group, and the like.

Next, some typical examples of the spectral sensitizers capable of being used in the invention are given below, and it is, however, to be understood that the invention shall not be limited to the spectral sensitizers given below:

Formula [I]

I-1

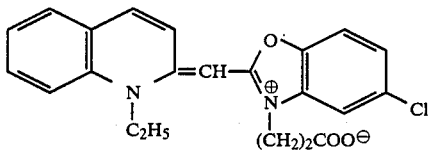

-continued
I-2
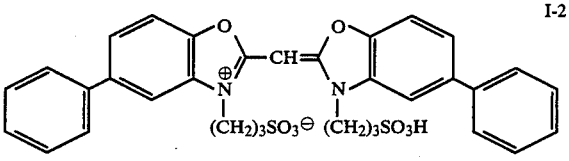
I-3
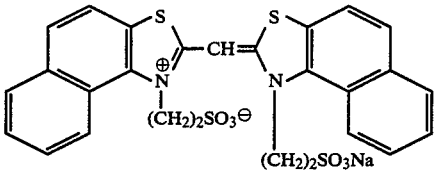
I-4
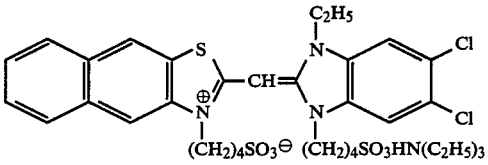
I-5
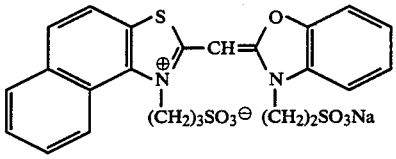
I-6
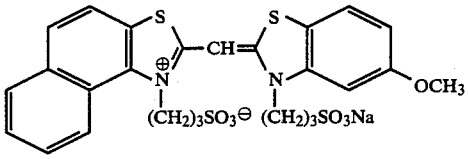
I-7
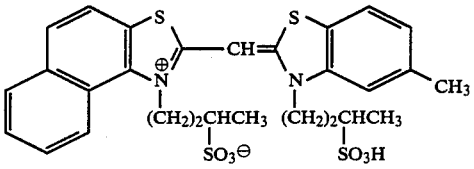
I-8
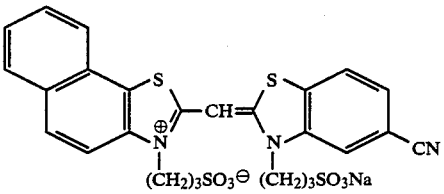
I-9
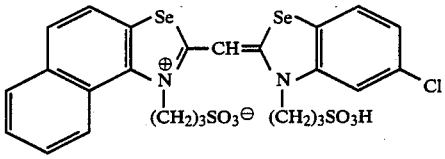
I-10
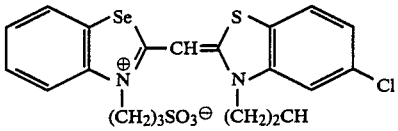
-continued
I-11
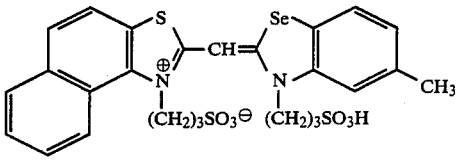
I-12
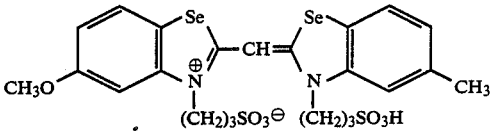
I-13
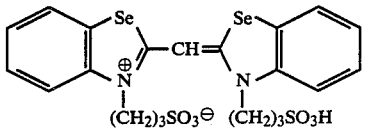
I-14
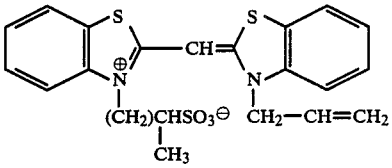
I-15
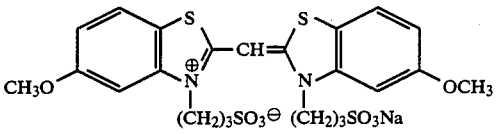
I-16
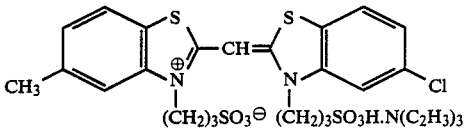
I-17
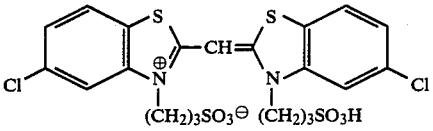
I-18
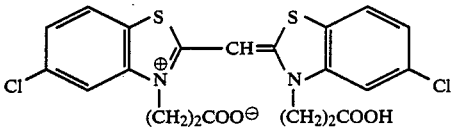
I-19
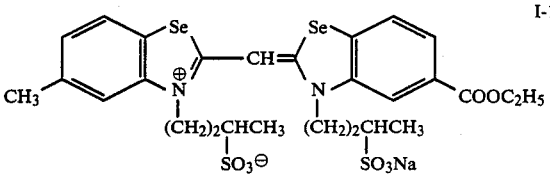
I-20
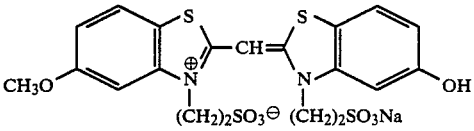

-continued

I-21

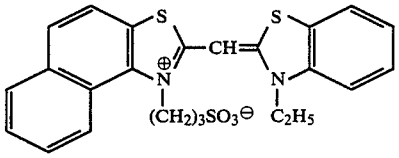

I-22

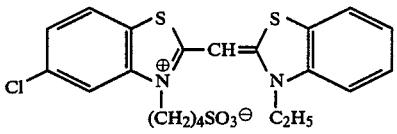

I-23

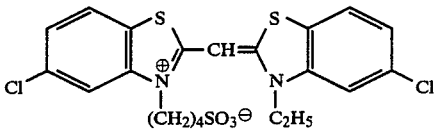

Formula [II]

II-1

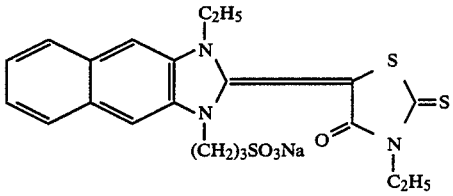

II-2

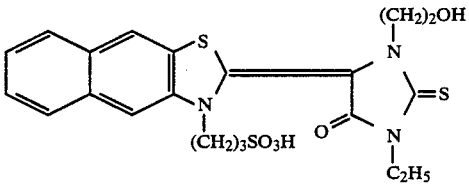

II-3

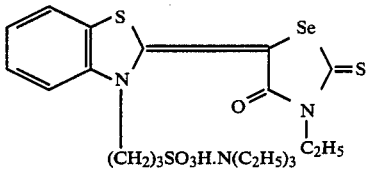

II-4

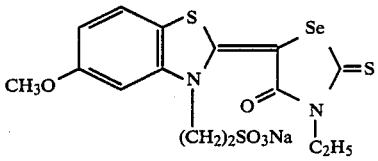

II-5

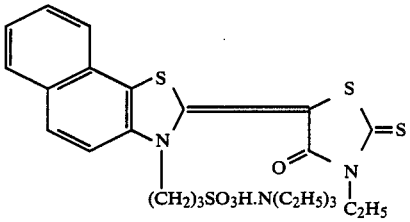

-continued

II-6

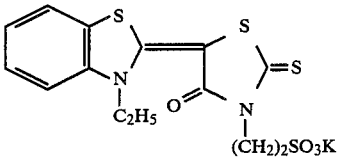

II-7

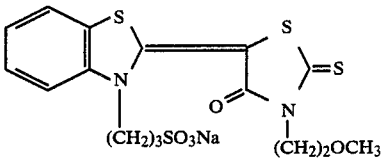

II-8

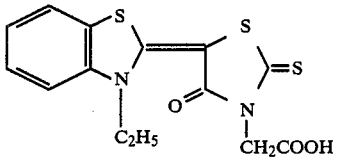

II-9

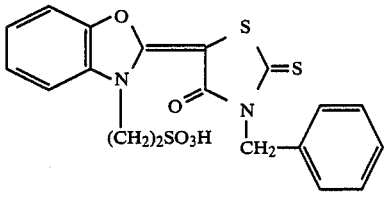

II-10

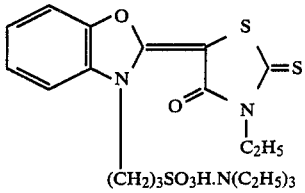

II-11

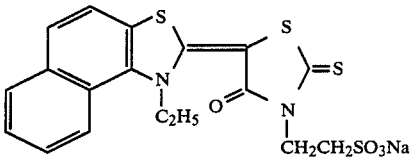

II-12

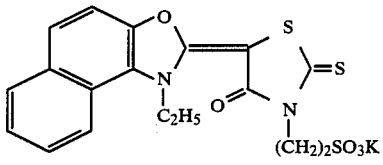

The spectral sensitizers of the invention represented by Formulas [I] and [II] have already publicly known. Therefore, they can easily be synthesized in accordance with such a process as that disclosed in F. M. Hamer, 'The Chemistry of Heterocyclic Compounds', Vol. 18 or A. Weissberger, 'The Cyanine Dye and Related Compounds', New Edition, published by Inter-science, New York, 1964.

There is no particular limitation to an amount added of the spectral sensitizers used in the invention. The preferable amounts thereof are to be within the range between $5\times10^{-6}$ and $5\times10^{-3}$ mole per mole of a silver halide used.

The spectral sensitizers of the invention may be added to an emulsion in any method which has been well-known in the art.

For example, these spectral sensitizers may directly be dispersed in an emulsion, or may be added in the form of an aqueous solution. In addition, they may also be adde to an emulsion in the form of solution prepared by dissolving them in a water soluble solvent such as those of pyridine, methyl alcohol, ethyl alcohol, methyl cellosolve, acetone or the like or the mixtures of the above-mentioned solvents, or prepared by diluting them with water in some case. It is also advantageous to dissolve them in a supersonic oscillation method. Besides the above, the spectral sensitizers of the invention may be added to an emulsion in such a method as described in U.S. Pat. No. 3,469,987 that such spectral sensitizers are dissolved in a volatile organic solvent and the resulting solution is dispersed in a hydrophilic colloid, and the resulting dispersed matter is added to the emulsion, or in such a method as described in Japanese Patent Examined Publication No. 24185/1971 that they are dispersed in a water soluble solvent without dissolving any non-water-soluble dyes and the resulting dispersed matter is added to the emulsion. Further, the described spectral sensitizers may be added, in the form of a dispersed matter prepared in an acid dissolution-dispersion method, into an emulsion. Still further, the methods described in U.S. Pat. Nos. 2,912,345, 3,342,605, 2,996,287, 3,425,835 and the like may also be used to add them to the other emulsions.

The spectral sensitizers of the invention may be added to an emulsion at any time in the course of preparing the emulsion. However, the preferable time for adding them is in the course of or after the chemical ripening process of the emulsion. It is also useful to add them further in a coating solution, for an improvement of coating solution stability, provided that an amount added thereof is less than that which may raise a problem of residual color stains.

The spectral sensitizers are allowed to use independently or in combination, and to add at the same time or separately. When adding them separately, the adding order, timing and intervals of such spectral sensitizers may be determined arbitrarily according to the purposes of using them.

In this specification, the term, a saturated solubility of a hydrophilic colloid, means an maximum dissolved amount (in milligram) of the following compounds [A] to 100 ml of an aqueous solution of 6% gelatin to be tested at 40° C.; Compound [A]

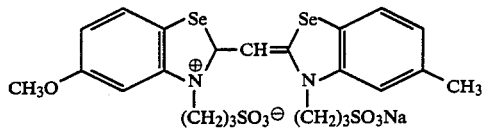

The measurements of the saturated solubility are carried out in the following method:

A gelatin to be tested is dissolved in pure water and the solution to be tested is so prepared as to adjust the gelatin concentration may be 6% by weight/volume in the final stage of the preparation.

An aqueous solution containing the Compound [A] at 0.15 wt % thereof is dropped into the aqueous solution of gelatin under the conditions of agitation at 40° C., at the rate of from 5 ml to 10 ml per minute. After dropping it, the solution to be tested is prepared by further agitating for one minute.

In the above-mentioned preparation process, a plurality of the solutions to be tested are prepared so that each of the differences between the amounts added of the Compound [A] to 100 ml of the original solution to be tested may be 1 mg. Each of the resulting solutions to be tested is allowed to stand at 40° C. for 12 hours.

After a lapse of 12 hours, the spectral transmittance of each solution to be tested is measured in terms of 750 nm by means of a spectrophotometer. (At this time, the solutions to be tested are added to the samples, while an aqueous solution of 6% (by wt/vol) gelatin not added with Compound [A] is added to the standard solution.) The measurements resulted that the spectral transmittance each of the solution tested were lowered as the amount added of Compound [A] was increased, that is to say, the solutions were made turbid by the deposition of Compound [A]. The amount (in milligram) of Compound [A] per 100 ml of each of the solution tested at this time denotes the saturated solubility of the corresponding gelatin tested. To be more concrete, as shown in FIG. 1, the amount (in milligram) of Compound [A] per 100 ml of each solution tested and the spectral transmittance thereof in 750 nm are plotted to find a bending point, so that a saturated solubility may be obtained.

In the above-mentioned method relating to the invention, the difference between every amount of Compound [A] added to the solutions tested was adjusted to 1 mg each. If a further accuracy is required in the measurements, more accurate measurements can be made by making the difference further smaller.

Whenever carrying out the above-mentioned measurements, it is required to consider that the ordinary type gelatin grains contain usually moisture of the order of about 10% by weight. Therefore, when measuring, for example, a moisture content is to be added on to measure. To the measurement of the moisture content of each gelatin, there may be applied with, for example, a gravimetric method, i.e., a heating loss measuring method, or a high-frequency moisture meter, each of which is one of the popularly using moisture content measuring methods. Photographic gelatins are made of collagens of cattle hide, cattle bones or pig skin, which are called a hide gelatin, an ossein geltin and pig skin gelatin, respectively. Before extracting such a gelatin, the raw materials thereof are dipped in an acid or an alkaline liquid for a long time to remove therefrom such an unnecessary matter as fat, calcium and the like. The gelatins treated with such an acid as sulfuric acid are called an acid-processed gelatin, and the gelatins treated with lime are called a lime-processed gelatin or an alkine-processed gelatin. The materials such as skins and bones are processed with an acid or alkali, and are then dipped in hot-water to extract gelatins from the tissues. Such an extraction is not carried out at a time, but is carried out several times separately. Gelatins extracted relatively earlier are used for photographic purposes. The later the extraction is made, the poorer such a quality as physical properties or color.

The extracted liquid is condensed by means of an evaporator. The resulting condensed liquid is made flow to spread on a belt or drum and is then gelled by cooling. The resulting gels are cut into small pieces and dried by hot-air drying. The resulting dried small pieces are pulverized to form the gelatin grains.

The gelatins of the invention include not only gelatins but also derivative gelatins including, for example, the reaction products of gelatin with an acid anhydride, the reaction products of gelatin with an isocyanate, the reaction products of gelatin with a compound having an active halogen atom, and the like. The acids anhydride used in the reaction with gelatin include, for example, maleic acid anhydride, phthalic acid anhydride, benzoic acid anhydride, acetic acid anhydride, isatoic acid anhydride, succinic acid anhydride and the like, and the isocyanate compounds include, for example, phenyl isocyanate, p-bromophenyl isocyanate, p-chlorophenyl isocyanate, p-tolyl isocyanate, p-nitrophenyl isocyanate, naphthyl isocyanate and the like.

Further, the compounds each having an active halogen include, for example, benzenesulfonyl chloride, p-methoxy benzenesulfonyl chloride, p-phenoxybenzenesulfonyl chloride, p-bromobenzenesulfonyl chloride, p-toluenesulfonyl chloride, m-nitrobenzenesulfonyl chloride, m-sulfobenzoyl dichloride, naphthalene-β-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, p-nitrobenzoyl chloride, benzoyl chloride, ethylchlorocarbonate, fluoroyl chloride and the like.

The gelatins of the invention may be the gelatins prepared in any preparation processes and may also be selected from the gelatins being placed on the market, provided that the saturated solubility thereof is not more than 10 according to the aforementioned definition.

The silver halide emulsions of the invention may be anyone prepared in a neutralization process, an acid process or an ammonia process and, in particular, the emulsions prepared in the acid process are preferred to use. It is advisable to prepare such emulsions at a pH value of preferably not higher than 5 and more preferably not higher than 4 in the course of producing silver halide grains.

How to react a soluble silver salt with a soluble halide may be carried out in anyone of a normal precipitation process, a reverse precipitation process, a double-jet precipitation process or the combination processes thereof and inter alia, the reaction products thereof obtained in the double-jet precipitation process are preferred. In addition, with the purpose of improving the monodispersibility thereof, it is also possible to use a pAg-controlled-double-jet precipitation processes, such as described in Japanese Patent O.P.I. Publication No. 48521/1979 and the like.

If occasion demands, it is also allowed to use such a silver halide solvent as thioether or the like, or such a crystal-habit controller as a mercapto-group-containing compound, a spectral sensitizer or the like.

The grain-size distribution of the silver halide grains to be used in the invention may be in a polydispersion pattern and a monodispersion pattern either, and the emulsions thereof are preferred to be of a monodisperse type. The monodispersed emulsions mentioned herein means such an emulsion containing silver halide grains whose variation coefficient in the grain distribution is not more than 22% and preferably not more than 15%. The above-mentioned variation coefficient is a coefficient indicating the breadth of a grain-size distribution, which is defined by the following formula:

$$\text{Variation coefficient} = \frac{\text{Standard deviation of grain-size distribution}}{\text{Average grain-size}} \times 100$$

$$\text{Standard deviation of grain-size distribution} = \frac{\Sigma(\bar{r} - ri)^2 ni}{\Sigma ni}$$

$$\text{Average grain-size} = \frac{\Sigma niri}{\Sigma ni} = r$$

Wherein, ri represents the grain-sizes of individual grains, and ni represents the number thereof. Average grain-size means the diameter of silver halide grains when they are globular, and the average diameter of the projected images of cubic grains or grains in the other form than globular form, in terms of the circular images having the same area as those of the grains, and they are represented by the abovegiven formulas, provided that the grain-sizes of individual grains are ri and the number thereof is ni.

The above-mentioned grain-sizes may be measured in various methods popularly used in the relative technical fields for the above-mentioned purpose. The typical methods are described in, for example, Loveland, 'Grain-Size Measurement', published in A.S.T.M. Symposium on Light-Microscopy, 1955, pp. 94~122; and Mees and James, 'The Theory of the Photographic Process' 3rd Ed., Macmillan Co., 1966, 2nd Chapter.

The relationship between grain-size distributions may be determined in the method described in A. P. H. Trivelli and W. F. Smith, 'An Experimental Relationship Between Sensitometric Distributions and Grain Distributions in Photographic Emulsions', The Photographic Journal, Vol. IXXIX, 1949, pp. 330~338.

There is no particular limitation to the silver halide composition of the silver halide grains being contained in a silver halide emulsion of the invention. It is, however, preferred that the silver iodide contents are small and such emulsion is substantially a silver chlorobromde emulsion. The silver chlorobromide emulsion mentioned herein substantially means that the silver halide of the silver halide grains being contained in a silver halide emulsion comprises silver iodide in an amount of less than 1 mole % and the remains which are silver chloride and silver bromide; and wherein it is preferred that the silver chloride contents of such silver halide grains is not less than 5 mole %.

Any crystal habits of silver halide grains may be used in the invention, however, the most preferable one is octahedral grains each having mainly a (111) face.

The specification of the crystal faces of a silver halide grain is defined by a diffraction-ray intensity ratio of (200) face corresponding to (100) face to (222) face corresponding to (111) face in accordance with the powdered X-ray diffractometry described in Japanese Patent O.P.I. Publication No. 20243/1984.

$$K = \frac{\text{Diffraction intensity belonged to (200) face}}{\text{Diffraction intensity belonged to (222) face}}$$

It is desired that the silver halide emulsions of the invention contain silver halide grains each having the above-mentioned K value within the range of $K < 3$ and more preferably $K \leqq 1.5$.

In the silver halide grains being contained in the silver halide emulsions of the invention, a latent image may be mainly formed on the surface thereof and formed inside, either.

However, in order to satisfactorily display the effects of the invention, it is preferred to use the silver halide grains capable of forming a latent image on the surface thereof, in a state before a chemical ripening process is carried out after the silver halide grains are formed, or in a state where the silver halide grains are finally formed if a chemical ripening process is carried out in the course of forming the silver halide grains.

Such silver halide grains may be evaluated typically in the method described in Japanese Patent Examined Publication No. 34214/1977. To be more concrete, a sample is prepared by coating on the polethylene-coated support thereof with a silver halide emulsion containing silver halide grains subject to test in a silver-coating amount of 40 mg per $dm^2$, and the resulting sample is exposed to a 500 watt tungsten lamp for a certain time of from $1\times10^{-2}$ to 1 second through a light-intensity scale, and is then developed in the developer Y mentioned below (an internal type developer) at 65° F. for 5 minutes. When it is tested in accordance with an ordinary photographic testing technique, there uses a silver halide emulsion which has a maximum density of not more than 5 times and preferably not more than double as compared with the maximum density of a sample coated with the same silver halide emulsion as above which is exposed in the same manner and developed in the undermentioned developer X (a surface type developer) at 65° F. for 6 minutes.

| Developer X | |
|---|---|
| N-methyl-p-aminophenol sulfate | 2.5 g |
| Ascorbic acid | 10.0 g |
| Potassium metaborate | 35.0 g |
| Potassium bromide | 1.0 g |
| Add water to make | 1000 cc |
| | (pH = 9.6) |
| **Developer Y** | |
| N-methyl-p-aminosulfate | 2.0 g |
| Sodium sulfite, anhydrous | 90.0 g |
| Hydroquinone | 8.0 g |
| Sodium carbonate $1H_2O$ | 52.5 g |
| Potassium bromide | 5.0 g |
| Potassium iodide | 0.5 g |
| Add water to make | 1000 cc |

The silver halide emulsions capable of being used in the invention may be chemically ripened in such a process as has usually been carried out by the skilled in the art, which includes, for example, the processes described in such a published literature as the aforementioned, Mees, 'The Theory of Photographic Process', or the other various processes which have so far been well-known. To be more concrete, there may be used various sensitizing processes, independently or in combination, such as a sulfur sensitizing process using a compound containing sulfur capable of reacting with silver ions such as a thiosulfate and the compounds described in U.S. Pat. Nos. 1,574,944, 2,278,947, 2,410,689, 3,189,458, and 3,501,313, French Patent No. 2,059,245, and the like; or an active gelatin; a reduction-sensitizing process such as those using a reducible substance including for example, a stannous salt described in U.S. Pat. No. 2,487,850, an amino described in U.S. Pat. Nos. 2,518,698, 2,521,925, 2,521,926, 2,419,973 and 2,419,975, and the like, iminoaminomethane sulfinic acid described in U.S. Pat. No. 2,983,610, a silane compound described in U.S. Pat. No. 2,694,637, and the like, or the H. W. Wood's process described in Journal of Photographic Science, Vol. 1, 1953, pp. 163–; a gold-sensitizing process using a gold complex salt and a gold thiosulfuric acid complex salt described in U.S. Pat. No. 2,399,083; a sensitizing process using such a noble metal salt as alloys, palladium, rhodium or ruthenium described in U.S. Pat. Nos. 2,448,060, 2,540,086, 2,566,245, 2,566,263 and the like. Further, a selenium sensitizing process described in U.S. Pat. No. 3,297,446 may also be used, in place of or together with the above-mentioned sulfur sensitizing process.

In the invention, it is also allowed to use a mixture of not less than two kinds of silver halide emulsions which are separately prepared. In this case, not less than two kinds of silver halide emulsions may be mixed up at any time. It is, however, more preferable to mix them up after they are most suitably chemically sensitized separately.

The silver halide emulsions to be used in the invention are allowed to contain various compounds, with the purposes of preventing a fog occurrence in the course of manufacturing processes, preservation of developing process, or stabilizing the photographic characteristics thereof.

There may be added with various compounds which have been well-known as an antifoggant or stabilizer including, for example, a tetrazaindene and an azole such as a benzothiazolium salt, a nitroindazole, a nitrobenzimidazole, a chlorobenzimidazole, a bromobenzimidazole, a mercaptothiazole, a mercaptobenzimidazole, an aminotriazole, a benzotriazole, a nitrobenzotriazole, a mercaptotetrazole including, in particular, 1-phenyl-5-mercaptotetrazole; and a mercaptopyrimidine and a mercaptotriazine including, for example, a thioketo compound such as oxazolithione; and further, benzenethiosulfinic acid, benzenesulfinic acid, benzenesulfonic acid amide, a hydroquinone derivative, an aminophenol derivative, a gallic acid derivative, an ascorbic acid derivative and the like.

Hydrophilic colloids for forming a hydrophilic colloidal layer containing the silver halide grains of the invention shall not be limited to use as the other hydrophilic colloids, provided that they contain the gelatins of the invention in an amount of not less than 35% by weight. If occasion demands, gelatins including those of the invention and various substances may further be used to serve as the binders of the other light-sensitive layers or non-light-sensitive layers. Besides the gelatins, there are allowed to use a colloidal albumin, agar, gum arabic, dextran, alginic acid, a cellulose derivative such as cellulose acetate hydrolysed up to 19% to 26% in the acetyl content thereof, a polyacrylamide, imido-polyacrylamide, casein, a vinyl alcohol polymer containing a urethanecarboxylic or cyanoacetyl group such as vinyl alcohol-vinyl cyanoacetate polymer, a polyvinyl alcohol, a polyvinyl pyrolidone, hydrolysed polyvinyl acetate, a polymer obtained by polymerizing monomers having a protein or a saturated acylated protein and a vinyl group, a polyvinylpyridine, a polyvinylamine, a polyaminoethyl methacrylate, a polyethyleneimine, and the like.

To serve as a hardening agent, such an organic hardner of a vinylsulfone, an acryloyl, an ethyleneimine or the like, or such an inorganic hardner as chrome alum, potassium alum or the like, for example, may be used independently or in combination.

The light-sensitive materials of the invention are also allowed to contain a surface active agent with the purposes of preventing electrostatic and adhesion, and emulsion-dispersing for improving slip-property or the like, as well as a coating assistant.

The surface active agents include, for example, those given in Japanese Patent O.P.I. Publication Nos. 10722/1974, and 16525/1975, as well as saponin, sodium dodecylbenzenesulfonate and sodium sulfosuccinate.

When applying the light-sensitive materials of the invention to a color light-sensitive material, various couplers may be used therein.

As for the couplers to be used in the invention, any compounds capable of forming a coupling product having its spectral absorption maximum in a region of long wavelengths than 340 nm and coupling to the oxidation products of a developing agent may be used. The typical examples thereof are given, in particular, as follows:

The couplers capable of forming a coupling product having a spectral absorption maximum wavelength in the range of from 350 nm to 500 nm typically include the so-called yellow couplers which are known among the skilled in the art. They are described in, for example, U.S. Pat. Nos. 2,186,849, 2,322,027, 2,728,658, 2,875,057, 3,265,506, 3,277,155, 3,408,194, 3,415,652, 3,447,928, 3,664,841, 3,770,446, 3,778,277, 3,849,140, and 3,894,875; British Pat. Nos. 778,089, 808,276, 875,476, 1,402,511, 1,421,126, and 1,513,832; Japanese Patent Examined Publication No. 13576/1974; Japanese Patent O.P.I. Publication Nos. 29432/1973, 66834/1973, 10736/1974, 122335/1974, 28834/1975, 132926/1975, 138832/1975, 3631/1976, 17438/1976, 26038/1976, 26039/1976, 50734/1976, 53825/1976, 75521/1976, 89728/1976, 102636/1976, 107137/1976, 117031/1976, 122439/1976, 143319/1976, 9529/1978, 82332/1978, 135625/1978, 145619/1978, 23528/1979, 48541/1979, 65035/1979, 133329/1979, and 598/1980; and the like.

The couplers capable of forming a coupling product having a spectral absorption maximum wavelength in the range of from 500 nm to 600 nm typically include the so-called magneta couplers which are known among the skilled in the art. They are described in, for example, U.S. Pat. Nos. 1,969,479, 2,213,986, 2,294,909, 2,338,677, 2,340,763, 2,343,703, 2,359,332, 2,411,951, 2,435,550, 2,592,303, 2,600,788, 2,618,641, 2,619,419, 2,673,801, 2,691,659, 2,803,554, 2,829,975, 2,866,706, 2,881,167, 2,895,826, 3,062,653, 3,127,269, 3,214,437, 3,253,924, 3,311,476, 3,419,391, 3,486,894, 3,519,429, 3,558,318, 3,617,291, 3,684,514, 3,705,896, 3,725,067 and 3,888,680; British Pat. Nos. 720,284, 737,700, 813,866, 892,886, 918,128, 1,019,117, 1,042,832, 1,047,612, 1,398,828 and 1,398,979; West German Patent Nos. 814,996 and 1,070,030; Belgian Patent No. 724,427; Japanese Patent O.P.I. Publication Nos. 60479/1971, 29639/1974, 111631/1974, 129538/1974, 13041/1975, 116471/1975, 159336/1975, 3232/1976, 3233/1976, 10935/1976, 16924/1976, 20826/1976, 26541/1976, 30228/1976, 36938/1976, 37230/1976, 37646/1976, 39039/1976, 44927/1976, 104344/1976, 105820/1976, 108842/1976, 112341/1976, 112342/1976, 112343/1976, 112344/1976, 117032/1976, 126831/1976, 31738/1977, 9122/1978, 35122/1978, 75930/1978, 86214/1978, 25835/1978, 123129/1978 and 56429/1979; and the like.

The couplers capable of forming a coupling product having a spectral absorption maximum wavelength in the range of from 600 nm to 750 nm typically include the so-called cyan couplers which are known among the skilled in the art. They are described in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and 3,839,044; British Pat. Nos. 478,991, 945,542, 1,084,480, 1,377,233, 1,388,024 and 1,543,040; Japanese Patent O.P.I. Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979 and 32071/1980; and the like.

The couplers capable of forming a coupling product having a spectral absorption maximum wavelength in the range of from 700 nm to 850 nm are described in, for example, Japanese Patent Examined Publication No. 24849/1977; Japanese Patent O.P.I. Publication Nos. 125836/1978, 129036/1978, 21094/1980, 21095/1980 and 21096/1980; and the like.

The photographic emulsions containing the silver halide grains of the invention are used generally together with the so-called yellow couplers. The particularly preferable yellow couplers are those of $\alpha$-pivaloylacetanilide type.

Besides the above, a colored magenta coupler, a colored cyan coupler, or a DIR coupler, a Weiss coupler, a competing coupler and the like may be used in the above-mentioned photographic emulsions. It is also allowed to use such a UV absorber as a benzotriazole compound, a thiazolidone compound, an acrylonitrile compound, a benzophenone compound and the like. It is further allowed to use, if occasion demands, an antistatic agent, an optical brightening agent, an oxidation inhibitor, a stain preventive and the like.

When a silver halide emulsion layer is to be provided onto a support after contained the above-mentioned photographic additives in the silver halide emulsions used in the invention, a subbing layer, an interlayer or the like are interposed between the support and the silver halide emulsion layer, if necessary.

The supports to be used therein include, for example, those made of sheets of paper, a glass plate, a cellulose acetate film, a cellulose nitrate film, a polyester film, a polyamide film, a polystyrene film or the like, or a member made by sticking no less than two bases together such as a laminated member of paper and a polyolefin such as a polyethylene, polypropylene or the like. These supports are usually applied with various surface improving treatments so as to improve the adhesive property thereof to a silver halide emulsion. Accordingly, a support surface-treated by an electron impact or the like, and a support treated by subbing the surface thereof to provide a subbing layer are used.

The above-mentioned supports are coated with a silver halide photographic emulsion in such a popularly known coating method as an impregnation coating method, a roller coating method, a bead-coating method, a curtain-coating method or the like, and are dried.

Such light-sensitive materials are ordinarily developed in black-and-white or in colors.

The color developing agents useful for such color developments include, for example, an aromatic primary amino compound such as N,N-diethyl-p-phenylenediamine, N-ethyl-N-hydroxyethylparaphenylenediamine, 4-(N-ethyl-N-hydroxyethyl)amino-2-methylaniline, 4-(N-ethyl-N-$\beta$-methanesulfonamidoethyl-amino-2-methylaniline, 4-(N,N-diethyl)-amino-2-methylaniline, 4-(N-ethyl-N-methoxyethyl)amino-2-methylaniline, and the sulfate, chloride, sulfite and p-toluene sulfonate thereof and the like.

After color developments, a bleaching step and a fixing step are taken. The preferable bleaching agents for developed silver include, for example, an organic acid polyvalent metal salt including an organic acid ferric salt as one of the examples. They include, for example, the iron salts of nitrilotriacetic acid, diethylenetriamine-pentaacetic acid, ethyleneglycolbis-(aminoethylether)-tetraacetic acid, diaminopropanol-tetraacetic acid, N-(2-hydroxyethyl)-ethylenediamine-triacetic acid, ethyliminodipropionic acid, cyclohexanediamine-tetraacetic acid, ethylenediamine-tetraacetic acid or the like. Further, it is also allowed to use such a polycarboxylic iron salt as indicated in Japanese Patent O.P.I. Publication No. 107737/1974, such as the iron salts of oxalic acid, malonic acid, succinic acid, tartaric acid, malic acid, citric acid, salicylic acid or the like. As for the polyvalent metals, besides the above-mentioned ferric salts, a cupric salt or a cobalt (III) salt may also be used. Further, according to the purposes, such an inorganic polyvalent metal salt as ferric chloride, ferric sulfate and the like may be used. As for the fixing agents, a thiosulfate thiocyanate and the like which have so far been well-known may be used, and they may be able to contain such a water-soluble alkaline metal salt as potassium bromide, ammonium bromide, sodium iodide and the like described in Japanese Patent O.P.I. Publication No. 101934/1973, a bromide of ammonium, or an iodide thereof.

It is also possible to apply a prehardening step, a neutralizing step, a washing step, a stabilizing step and the like in combination with a color-developing step or a bleaching-fixing step.

EXAMPLES

The invention will now detailedly be described with respect to the examples below, and it is, however, to be understood that any embodiments of the invention shall not be limited thereto.

EXAMPLE-1

Under acidified conditions and in a double-jet method, there prepared a silver halide emulsion (a) comprising silver chlorobromide grains having an average grain-size of 0.8 μm, each of which containing silver chloride in an amount of 5 mole %. The silver halide emulsion was that having a variation coefficient of 13% and comprised monodispersive tetradecahedral grains of K=78. When this emulsion was surface-developed and internal-developed in the aforementioned process, it was found that the maximum density ratio thereof after internal-development was 1.2 to the maximum density obtained after the surface-development.

Next, this emulsion was divided into several parts so that each part thereof was sulfur-sensitized in the presence of the corresponding spectral sensitizer shown in Table 1. After the sulfur-sensitization was completed, the following stabilizer [B] was added thereto in an amount of 1 g per mole of the silver halide used and then the following yellow-coupler [C] dissolved in dibutyl phthalate was added in an amount of 0.4 mole per mole of the silver halide so as to prepare a coating liquid. Immediately after the preparation thereof, after allowing it to stand for 3 hours at 42° C., after allowing to stand for 6 hours, and after allowing to stand for 10 hours, the respective samples were prepared by coating the liquid.

Each of the coating liquid was coated on a resin-coated paper support by adjusting the coating conditions so that the amount of silver coated can be 4.0 mg/dm$^2$ in terms of metal silver and the amount of gelatin can be 30 mg/dm$^2$, and then gelatin was coated thereon in an amount of 10 mg/dm$^2$ to serve as a protective layer, respectively.

Therein, as for the gelatins for forming the silver halide emulsion layers of the samples, gelatins 1 to 4 were used independently or in combination. The saturated solubility of the gelatins each was measured in the aforementioned measuring method.

| | Saturated solubility |
|---|---|
| Gelatin 1 (Moisture content: 11 wt %) | 3.2 |
| Gelatin 2 (Moisture content: 13 wt %) | 8.5 |
| Gelatin 3 (Moisture content: 10.5 wt %) | 14.0 |
| Gelatin 4 (Moisture content: 12 wt %) | 24.0 |

These samples each were exposed to light through a wedge and processed with the following color developer for 3.5 minutes, and treated with the following bleach-fixing solution for 1.5 minutes. After then, they were washed and dried. The resulted samples were tried to measure the sensitivity therof. The results therefrom are shown in Table 1. In the table, the sensitivity of every sample denotes a relative value to the sensitivity of Sample-1 coated immediately after it was prepared, which is regarded as 100.

| | |
|---|---|
| Composition of the color developer: | |
| N-ethyl-N-β-methanesulfonamido-ethyl-3-methyl-4-aminoaniline sulfonate | 4.0 g |
| Hydroxylamino sulfate | 2.0 g |
| Potassium carbonate | 25.0 g |
| Sodium chloride | 0.1 g |
| Sodium bromide | 0.1 g |
| Sodium sulfite, anhydride | 2.0 g |
| Benzyl alcohol | 10.0 ml |
| Polyethylene glycol (Average degree of polymerization: 400) | 3.0 ml |
| Add water to make | 1000.0 cc |
| Adjust the pH value with sodium hydroxide to pH 10.0 | |
| Composition of the bleach-fixing solution: | |
| Iron sodium ethylenediamine-tetraacetate | 60.0 g |
| Ammonium thiosulfate | 100.0 g |
| Sodium bisulfite | 20.0 g |
| Sodium metabisulfite | 5.0 g |
| Add water to make | 1000.0 cc |
| Adjust the pH value with sulfuric acid to pH 7.0 | |
| Oxidation-reduction potential | −70 mV |

TABLE 1

| Sample No. | Spectral Sensitizer (mole) | (× 10$^{-4}$ mole AgX) | Gelatin content in a silver halide emulsion layer (by wt) | Sensitivity: Immediately after preparation | After 3 hrs. | After 6 hrs. | After 10 hrs. | |
|---|---|---|---|---|---|---|---|---|
| 1 | [I-12] | 3.0 | Gelatin 3: 100 | 100 | 85 (85)*2 | 74 (74)*2 | 68 (68)*2 | Comparative |
| 2 | [I-12] | 3.0 | Gelatin 4: 100 | 98 | 83 (85) | 73 (74) | 65 (66) | " |
| 3 | [I-12] | 4.2*1 | " | 99 | 86 (87) | 75 (76) | 68 (69) | " |
| 4 | [I-12] | 3.0 | Gelatin-1/ | 102 | 91 (89) | 79 (77) | 73 (72) | " |

TABLE 1-continued

| Sample No. | Spectral Sensitizer (× $10^{-4}$ mole mole AgX) | | Gelatin content in a silver halide emulsion layer (by wt) | Sensitivity: Immediately after preparation | After 3 hrs. | After 6 hrs. | After 10 hrs. | |
|---|---|---|---|---|---|---|---|---|
| 5 | [I-12] | 3.0 | Gelatin-4 = 10/90 Gelatin-1/ Gelatin-4 = 20/80 | 105 | 95 (90) | 85 (81) | 79 (75) | " |
| 6 | [I-12] | 3.0 | Gelatin-1/ Gelatin-4 = 35/65 | 114 | 108 (95) | 105 (92) | 103 (90) | Invention |
| 7 | [I-12] | 3.0 | Gelatin-1/ Gelatin-4 = 50/50 | 115 | 109 (95) | 105 (91) | 104 (90) | " |
| 8 | [I-12] | 4.2*1 | Gelatin-1/ Gelatin-4 = 50/50 | 120 | 116 (97) | 115 (96) | 115 (96) | " |
| 9 | [I-15] | 3.0 | Gelatin-1/ Gelatin-4 = 40/60 | 112 | 105 (94) | 104 (91) | 95 (91) | " |
| 10 | [II-6] | 3.0 | Gelatin-1 Gelatin-4 = 40/60 | 104 | 99 (95) | 98 (92) | 94 (90) | " |
| 11 | [I-12] | 3.0 | Gelatin-2/ Gelatin-4 = 40/60 | 112 | 105 (94) | 102 (91) | 102 (91) | " |

*1After chemical ripening, an amount of 1.2 × 10 mole was added when a coating liquid was prepared.
*2Value in a parenthesis is a relative sensitivity when the sensitivity obtained immediately after the preparation is regarded as 100.

As is obvious from Table 1, in the case of Samples Nos. 1 through 3 in which the hydrophilic colloids of the silver halide emulsion layers were the gelatins other than those of the invention, i.e., Gelatin-3 and Gelatin-4, the coating liquid stability thereof was poor, and the sensitivity variations thereof became remarkably greater if coated on the supports after the coating liquids were stabilized. It was not almost successful to reduce such sensitivity variations when a conventionally known method of adding spectral sensitizers into the coating liquids. It was proved at any rate that such sensitivity variations were improved by using the gelatins of the invention within a specific range of the proportion in the gelatins of a silver halide emulsion layer. The improvement was not only less effective but also unsatisfactory when the proportion is less than that specified in the invention. In contrast with the above, when the gelatins of the invention were in an amount not less than 35% by weight of the hydrophilic colloids of a silver halide emulsion layer, the emulsion was highly sensitized and the sensitivity, variations thereof caused by the coating liquid stabilization were also improved.

EXAMPLE-2

In an ordinary method, there prepared silver halide emulsions (b), (c), (d) and (e) which comprise cubic grains, octahedral grains, twin-crystallized grains and grains having a lamination-structure, respectively, as shown in Table 2. Every one of the emulsions (b), (c), (d) and (e) is a silver halide emulsion comprising silver chlorobromide grains containing silver chloride in an amount of 5 mole %.

The above-mentioned silver halide grains having the lamination-structure were made in a modified method of the method described in Japanese Patent O.P.I. Publication No. 140444/1984 to prepare silver halide grains each comprising silver bromide and silver chloride arranged from the inside of the silver halide and silver bromide arranged on the uppermost surface of the silver halide.

TABLE 2

| Emulsion | Average grain-size | Variation coefficient | K | Configuration of grains |
|---|---|---|---|---|
| (b) | 0.82 | 11% | 1900 | Cubic |
| (c) | 0.79 | 10% | 0.6 | Octahedral |
| (d) | 0.81 | 20% | — | Deformed by twinning |
| (e) | 0.78 | 14% | 83 | Tetradeca hedral (Laminated type) |

Thus prepared emulsions (b) through (e) were surface-developed and internal-developed, respectively, in the aforementioned method taken in Example-1. Resultantly, the ratios of the maximum density of Emulsions (b) through (d) were not more than 2 while that of Emulsion (e) was 24 after the internal developments, to the maximum density thereof after the surface developments, respectively.

Next, the emulsions (b) through (e) were sulfur-sensitized in the presence of spectral sensitizer [I-12] in the method described in Example-1, respectively, to prepare coating liquids. The samples were prepared by coating the coating liquids immediately after the liquid preparation, after allowed it to stand for 4 hours at 42° C. and after allowed to stand for 8 hours, respectively. The samples were exposed to light and then developed to measure the respective sensitivity. The results therefrom are shown in Table 3.

TABLE 3

| Sample No. | Silver grain | | Spectral Sensitizer (× $10^{-4}$ mole mole AgX) | Proportion of gelatin content in a silver halide emulsion layer (by weight) | Sensitivity: Immediately after preparation | After 4 hrs. | After 8 hrs. | |
|---|---|---|---|---|---|---|---|---|
| 12 | b | (Cubic grain) | [I-12] 3.0 | Gelatin-1/ Gelatin-4 = 45/35 | 106 | 101 (95)*1 | 98 (92)*1 | Invention |
| 13 | c | (Octahedral grain) | " | Gelatin-1/ Gelatin-4 = 45/35 | 118 | 116 (98) | 114 (97) | " |
| 14 | d | (Twin-crystallized grain) | " | Gelatin-1/ Gelatin-4 = 45/35 | 90 | 96 (93) | 88 (91) | " |

TABLE 3-continued

| Sample No. | Silver grain | Spectral Sensitizer ($\times 10^{-4}$ mole mole AgX) | Proportion of gelatin content in a silver halide emulsion layer (by weight) | Sensitivity Immediately after preparation | After 4 hrs. | After 8 hrs. | |
|---|---|---|---|---|---|---|---|
| 15 | e (Tetradecahedral and laminated type) | " | Gelatin-1/ Gelatin-4 = 45/35 | 100 | 90 (90) | 85 (85) | " |
| 16 | a (Tetradecahedron) | " | Gelatin-1/ Gelatin-4 = 45/35 | 114 | 107 (94) | 104 (91) | " |
| 17 | a (Tetradecahedron) | " | Gelatin-1/ Gelatin-4 = 0/100 | 100 | 80 (80) | 70 (70) | Comparative |

*[1]The value in parentheses are values relative to the sensitivity regarded as 100 obtained immediately after preparation, respectively.

It is understandable from the Table 3 that the objects of the invention can be achieved even if any silver halide grains are used. It is, however, preferred to use a silver halide emulsion capable of forming a latent image mainly on the surface thereof, after the silver halide grains are formed and in the state before a chemical sensitization is carried out. In particular, a remarkable effect can be displayed when using silver halide emulsion comprising octadehedral grains.

EXAMPLE-3

Emulsion (c) prepared in Example-2 was sulfur-sensitized in the presence of the spectral sensitizers shown in Table-4 in the process mentioned in Example-1 to prepare the coating liquid. The samples were prepared by coating the resulting coating liquid thereon immediately after the preparation of the coating liquid, after allowing to stand for 4 hours, and after allowing to stand for 8 hours, at 42° C., respectively. The samples were exposed to light and developed to measure the sensitivity thereof. The results therefrom are shown in Table 4. Every sensitivity obtained are denoted relatively to the sensitivity obtained immediately after the preparation, which is regarded as 100.

TABLE 4

| Sample No. | Spectral Sensitizer ($\times 10^{-4}$ mole mole AgX) | Proportion of geltain content in a silver halide emulsion layer (by weight) | Sensitivity After 4 hrs. | After 8 hrs. | |
|---|---|---|---|---|---|
| 1 | [I-13] (3.0) | Gelatin-1/ Gelatin-4 = 40/60 | 97 | 96 | Invention |
| 2 | [II-10] (2.5) | Gelatin-1/ Gelatin-4 = 40/60 | 98 | 96 | " |
| 3 | Comparative spectral sensitizer D (2.5) | Gelatin-1/ Gelatin-4 = 40/60 | 84 | 76 | Comparative |
| 4 | Comparative spectral sensitizer E (2.0) | Gelatin-1/ Gelatin-4 = 40/60 | 80 | 72 | " |

As is apparent from Table 4, even if the gelatins of the invention should be used, the coating liquid stabilization becomes poor and the sensitivity variations thereof becomes greater when using a silver halide emulsion spectrally sensitized with the other spectral sensitizers than those of the invention.

EXAMPLE-4

A silver halide color light-sensitive material was prepared in such a manner that the following seven layers are superposedly coated in order on a resin-coated paper support. The amounts of the compounds added therein are in terms of 100 $cm^2$ of the color light-sensitive material.

Layer 1: A silver halide emulsion layer containing 8.0 mg of yellow couper [C], a blue-sensitive silver chlorobromide emulsion in an amount of 3.5 mg in terms of silver, 10 mg of Gelatin-1 and 10 mg of Gelatin-4.

Layer 2: An interlayer containing 0.2 mg of dioctylhydroquinone and 10 mg of Gelatin-4.

Layer 3: A green-sensitive silver halide emulsion layer containing 4.2 mg of magenta coupler [F], a green-sensitive silver chlorobromide emulsion in an amount of 3.5 mg in terms of silver, and 20 mg of Gelatin-4.

Layer 4: An interlayer containing 0.3 mg of dioctylhydroquinone, 8 mg of a UV absorbing agent and 15 mg of Gelatin-4.

Layer 5: A red-sensitive silver halide emulsion layer containing 3.5 mg of cyan coupler [G], a red-sensitive silver chlorobromide emulsion in an amount of 2.5 mg in terms of silver and 15 mg of Gelatin-4.

Layer 6: An interlayer containing 10 mg of Gelatin-4.

Layer 7: A protective layer containing 10 mg of Gelatin-4.

The blue-sensitive silver chlorobromide emulsion used in Layer 1 is the same as that used for preparing Sample No. 13 in Example 2.

The prepared sample was exposed to light through a color-negative and printed, and was then treated in the same process mentioned in Example-1. Resultantly, there obtained a color print excellent in color and tone reproducibility.

Also, even when continuously coating for a long time in manufacturing the above-mentioned color light-sensitive materials, there obtained a color light-sensitive material capable of enjoying stable quality without any scattering of sensitivity even in one and the same production lot.

Stabilizer [B]

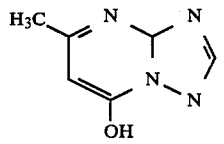

Yellow Coupler [C]

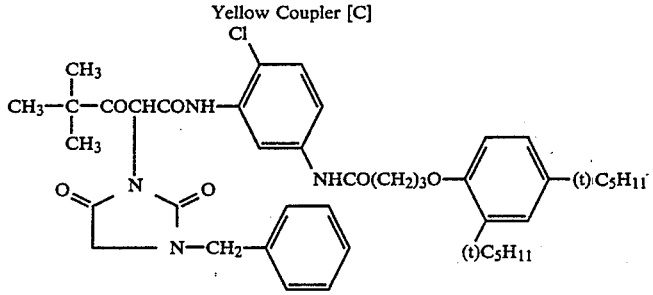

Comparative Spectral Sensitizer [E]

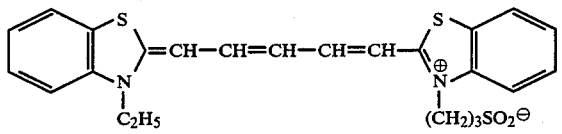

Comparative Spectral Sensitizer [D]

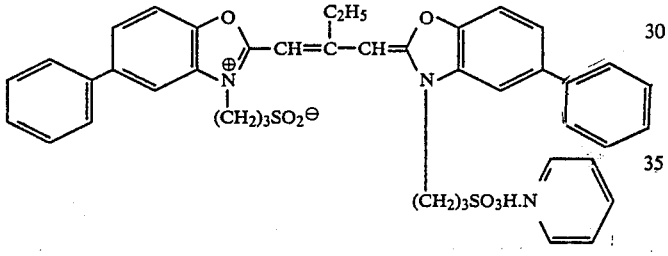

Magenta Coupler [F]

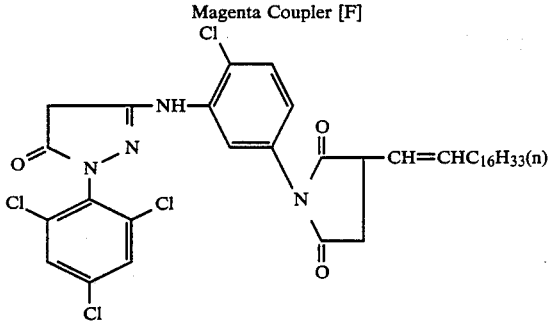

Cyan Coupler [G]

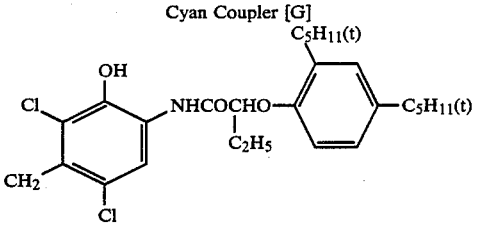

What is claimed is:

1. A silver halide photographic light-sensitive material comprising a support bearing thereon at least one hydrophilic colloidal layer containing silver halide grains spectrally sensitized with a spectral sensitizer, wherein the spectral sensitizers are selected from those represented by the following Formulas [I] and/or [II] and a hydrophilic colloid forming the hydrophilic colloidal layer contains gelatin whose saturated solubility is not more than 10 in an amount of not less than 35% by weight of the colloid Formula [I]

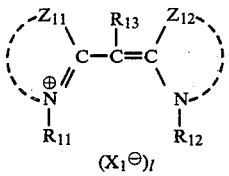

wherein $Z_{11}$ and $Z_{12}$ each represent a group of atoms necessary for forming a benzoxazole nucleus, naphthoxazole nucleus, benzothiazole nucleus, naphthothiazole nucleus, benzoselenazole nucleus, naphthoselenazole nucleus, benzoimidazole nucleus, naphthoimidazole nucleus, pyridine nucleus or quinoline nucleus; $R_{11}$ and $R_{12}$ each represent an alkyl group, an alkenyl group or an aryl group; $R_{13}$ represents hydrogen, a methyl group or an ethyl group; $X_1^{\ominus}$ represents an anion; and l represents zero or 1

Formula [II]

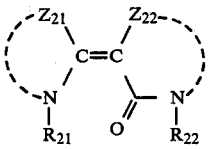

wherein $Z_{21}$ represents a group of atoms necessary for forming a benzoxazole nucleus, naphthoxazole nucleus, benzothiazole nucleus, naphthothiazole nucleus, benzoselenazole nucleus, benzoimidazole nucleus or naphthoimidazole nucleus; $Z_{22}$ represents a group of atoms necessary for forming a rhodanine nucleus, 2-thiohydantoine nucleus or 2-thioselenazoline-2,4-dione nucleus; and $R_{21}$ and $R_{22}$ each represent an alkyl group, alkenyl group or aryl group.

2. The silver halide photographic light-sensitive material as claimed in claim 1, wherein said silver halide grains are spectrally sensitized with a process sensitizer selected from those represented by said Formula [I] and/or Formula [II] in an amount of from $5\times10^{-6}$ to $5\times10^{-3}$ mole per mole of the silver halide.

3. The silver halide photographic light-sensitive material as claimed in claim 1, wherein said silver halide grains are in a monodispersive grain-size distribution.

4. The silver halide photographic light-sensitive material as claimed in claim 1, wherein said silver halide grains substantially comprises silver chloride and silver bromide.

5. The silver halide photographic light-sensitive material as claimed in claim 4, wherein the proportions of silver chloride content and silver iodide content of said silver halide grains are 5 mole % and not more than 1 mole %, respectively.

6. The silver halide photographic light-sensitive material as claimed in claim 1, wherein said silver halide grains are mainly octahedral grains having (111) face.

7. The silver halide photographic light-sensitive material as claimed in claim 1, wherein said silver halide grains are of the type capable of forming a latent image mainly on the surfaces thereof.

* * * * *